US007352349B2

(12) United States Patent
Baek et al.

(10) Patent No.: US 7,352,349 B2
(45) Date of Patent: Apr. 1, 2008

(54) METHOD AND APPARATUS FOR DRIVING LIQUID CRYSTAL DISPLAY

(75) Inventors: Jong Sang Baek, Kumi-shi (KR); Sun Young Kwon, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 646 days.

(21) Appl. No.: 10/873,452

(22) Filed: Jun. 23, 2004

(65) Prior Publication Data

US 2004/0263448 A1 Dec. 30, 2004

(30) Foreign Application Priority Data

Jun. 24, 2003 (KR) ..... 10-2003-0041124

(51) Int. Cl.
*G09G 3/36* (2006.01)

(52) U.S. Cl. ..... 345/92; 345/98

(58) Field of Classification Search ..... 345/87, 345/94, 96, 98, 100, 213, 92
See application file for complete search history.

(56) References Cited

U.S. PATENT DOCUMENTS 6,011,530 A * 1/2000 Kawahata et al. ..... 345/92
6,271,821 B1 * 8/2001 Sung et al. ..... 345/100
6,310,618 B1 * 10/2001 Zhang et al. ..... 345/213
6,980,191 B2 * 12/2005 Nakamura et al. ..... 345/98
6,982,690 B2 * 1/2006 Lee et al. ..... 345/92
7,154,464 B2 * 12/2006 Lee et al. ..... 345/96

* cited by examiner

*Primary Examiner*—Richard Hjerpe
*Assistant Examiner*—Kevin M Nguyen
(74) *Attorney, Agent, or Firm*—McKenna, Long & Aldridge LLP

(57) ABSTRACT

A method and apparatus for driving a liquid crystal display for reducing the number of data lines is disclosed. In the apparatus, a timing controller receives red sub-pixel data, green sub-pixel data and blue sub-pixel data from the exterior thereof and then divides the received data into odd-numbered sub-pixel data and even-numbered sub-pixel data. A data driver receives the odd-numbered sub-pixel data and the even-numbered sub-pixel data from the timing controller during one horizontal period and then applies the received odd-numbered and even-numbered sub-pixel data to data lines during the one horizontal period.

21 Claims, 12 Drawing Sheets

METHOD AND APPARATUS FOR DRIVING LIQUID CRYSTAL DISPLAY

This application claims the benefit of the Korean Patent Application No. P2003-41124 filed in Korea on Jun. 24, 2003, which is hereby incorporated by reference for all purposes as if fully set forth herein.

BACKGROUND OF THE INVENTION

1. Field of the Invention

This invention relates to a liquid crystal display, and more particularly to a method and apparatus for driving a liquid crystal display that is adaptive for reducing the number of data lines.

2. Description of the Related Art

Generally, a liquid crystal display (LCD) controls a light transmittance of a liquid crystal using an electric field to display a picture. To this end, the LCD includes a liquid crystal display panel having a pixel matrix, and a driving circuit for driving the liquid crystal display panel. The driving circuit drives the pixel matrix such that picture information can be displayed on the display panel.

FIG. 1 shows a related art liquid crystal display device.

Referring to FIG. 1, the conventional LCD includes a liquid crystal display panel 2, a data driver 4 for driving data lines DL1 to DLm of the liquid crystal display panel 2, and a gate driver 6 for driving gate lines GL1 to GLn of the liquid crystal display panel 2.

The liquid crystal display panel 2 has thin film transistors TFT each of which is provided at each crossing between the gate lines GL1 to GLn and the data lines DL1 to DLm, and liquid crystal cells connected to the thin film transistors TFT and arranged in a matrix.

The gate driver 6 sequentially applies a gate signal to each gate line GL1 to GLn in response to a control signal from a timing controller (not shown). The data driver 4 converts data signals for red (R), green (G), and blue (B) from the timing controller into analog video signals to thereby apply video signals for one horizontal line to the data lines DL1 to DLm each one horizontal period when a gate signal is applied to each gate line GL1 to GLn.

The thin film transistor TFT applies data from the data lines DL1 to DLm to the liquid crystal cell in response to a control signal from the gate lines GL1 to GLn. The liquid crystal cell can be equivalently expressed as a liquid crystal capacitor Clc because it has a common electrode opposite a pixel electrode each other having liquid crystal therebetween. The pixel electrode is connected to the thin film transistor TFT. Such a liquid crystal cell includes a storage capacitor (not shown) connected to a pre-stage gate line in order to keep data voltage charged in the liquid crystal capacitor Clc until the next data voltage is charged therein.

The liquid crystal cells of the related art LCD has vertical lines equal to the number (i.e., m) of the data lines DL1 to DLm because pixels are provided at crossings between the gate lines GL1 to GLn and the data lines DL1 to DLm. In other words, the liquid crystal cells are arranged in a matrix in such a manner as to make m vertical lines and n horizontal lines.

The conventional LCD requires m data lines DL1 to DLm so as to drive the liquid crystal cells having m vertical lines. Therefore, the conventional LCD has a drawback in that a number of data lines DL1 to DLm should be provided to drive the liquid crystal display panel 2. Hence, process time and manufacturing resources are wasted. Furthermore, the conventional LCD has a problem in that, since a large number of data driving integrated circuits (IC's) are included in the data driver 4 so as to drive the m data lines DL1 to DLm, the manufacturing costs are high.

SUMMARY OF THE INVENTION

Accordingly, the present invention is directed to a method and apparatus for driving a liquid crystal display that is adaptive for reducing the number of data lines that substantially obviates one or more of the problems due to limitations and disadvantages of the related art.

In order to achieve these and other advantages of the invention, a driving apparatus for a liquid crystal display, including a plurality of data lines with sub-pixels arranged at the left and right sides thereof in such a manner to be connected to each data line, according to one aspect of the present invention includes a timing controller for receiving red sub-pixel data, green sub-pixel data and blue sub-pixel data from the exterior thereof and then dividing the received data into odd-numbered sub-pixel data and even-numbered sub-pixel data; and a data driver for continuously receiving the odd-numbered sub-pixel data and the even-numbered sub-pixel data from the timing controller during one horizontal period and then applying the received odd-numbered and even-numbered sub-pixel data to the data lines during the one horizontal period.

In the driving apparatus, the timing controller includes a first data separator that separates each of the red, green and blue sub-pixel data into odd-numbered data and even-numbered data to generate a first sub-pixel data; a second data separator that separates the first sub-pixel data into odd-numbered sub-pixel data and even-numbered sub-pixel data to generate a second sub-pixel data; data storage that stores the second sub-pixel data; and a storage controller that controls the data storage means.

Herein, the controller includes a modified data enable signal generator that divides a data enable signal from the exterior thereof into two frequencies to generate a modified data enable signal.

Herein, the modified data enable signal generator divides each of a high region and a low region of the data enable signal into two regions and makes a summation of the two-divided high region and the two-divided low region, thereby generating the modified data enable signal.

The modified data enable signal generator includes a counter for counting one period of the data enable signal; a subtracter for subtracting a low region of the data enable signal from the counted one-period time to calculate a high region of the data enable signal; a divider for dividing the high region of the data enable signal outputted from the subtracter by two; and an adder for adding the two-divided high region of the data enable signal outputted from the divider to the two-divided low region of the data enable signal stored therein to generate the modified data enable signal.

The first data separator divides each of the red, green and blue sub-pixel data into odd-numbered sub-pixel data and even-numbered sub-pixel data to generate a first sub-pixel data including odd red sub-pixel data, even red sub-pixel data, odd green sub-pixel data, even green sub-pixel data, odd blue sub-pixel data and even blue sub-pixel data; and the second data separator divides the odd red sub-pixel data, the even red sub-pixel data, the odd green sub-pixel data, the even sub-pixel data, the odd blue sub-pixel data and the even blue sub-pixel data into odd-numbered sub-pixel data and even-numbered sub-pixel data to generate a second sub-pixel data including odd red sub-pixel data(odd), odd red sub-pixel data(even), even red sub-pixel data(odd), even red sub-pixel data(even), odd green sub-pixel data(odd), odd green sub-pixel data(even), even green sub-pixel data(odd), even green sub-pixel data(even), odd blue sub-pixel data (odd), odd blue sub-pixel data(even), even blue sub-pixel data(odd) and even blue sub-pixel data(even).

The data storage means includes at least two line memories for storing the second sub-pixel data.

Preferably, the data storage means includes four line memories for storing the second sub-pixel data.

Herein, the controller alternately stores the odd-numbered sub-pixel data of the second sub-pixel data into the first and third line memories, and alternately stores the even-numbered sub-pixel data of the second sub-pixel data into the second and fourth line memories.

Herein, the data stored in the first line memory is applied to the data driver in the ith period (wherein i is an integer) of the modified data enable signal, and the data stored in the second line memory is applied to the data driver in the (i+1)th period of the modified data enable signal.

Herein, during the ith and (i+1)th periods, the odd-numbered sub-pixel data is stored in the third line memory and the even-numbered sub-pixel data is stored in the fourth line memory.

The data stored in the third line memory is applied to the data driver in the ith period (wherein i is an integer) of the modified data enable signal, and the data stored in the fourth line memory is applied to the data driver in the (i+1)th period of the modified data enable signal.

Herein, during the ith and (i+1)th periods, the odd-numbered sub-pixel data is stored in the first line memory and the even-numbered sub-pixel data is stored in the second line memory.

The timing controller includes a gate controller for applying first and second gate signals from a gate driver to gate lines and for controlling the gate driver such that the second gate signal applied to the ith gate line (wherein i is an integer) can overlap with the first gate signal applied to (i+2)th gate line.

Herein, the gate controller generates a gate start pulse remaining at a high state during three periods of the modified data enable signal, first to third output enable signals remaining at a high state during three periods of the modified data enable signal while remaining at a low state during three periods of the modified data enable signal, and a gate shift clock remaining at a high state during one period of the modified data enable signal while remaining at a low state during one period of the modified data enable signal, thereby applying them to the gate driver.

Herein, the second output enable signal rises at a time delayed by two periods of the modified data enable signal from a rising time of the first output enable signal, and the third output enable signal rises at a time delayed by two periods of the modified data enable signal from a rising time of the second output enable signal.

A method of driving a liquid crystal display, including plurality of data lines with sub-pixels arranged at the left and right sides thereof in such a manner to be connected to each data line, according to another aspect of the present invention includes the steps of (A) making a two-frequency-division of a data enable signal supplied from the exterior thereof to generate a modified data enable signal; (B) dividing sub-pixel data supplied from the exterior thereof into odd-numbered sub-pixel data and even-numbered sub-pixel data; (C) applying the odd-numbered sub-pixel data to the data lines during one period of the modified data enable signal; and (D) applying the even-numbered sub-pixel data to the data lines during one period of the modified data enable signal.

In the method, the (A) step includes generating the modified data enable signal by making a summation of a two-divided high region and a two-divided low region of the data enable signal.

The (B) step includes dividing each of red, green and blue sub-pixel data from the exterior thereof into odd-numbered sub-pixel data and even-numbered sub-pixel data to generate a first sub-pixel data; dividing the first sub-pixel data into odd-numbered sub-pixel data and even-numbered sub-pixel data to generate a second sub-pixel data; and extracting the odd-numbered sub-pixel data and the even-numbered sub-pixel data from the second sub-pixel data and storing them.

The method further includes the step of (E) applying first and second gate signals to gate lines and generating a control signal such that the second gate signal applied to the ith gate line (wherein i is an integer) can overlap with the first gate signal applied to (i+2)th gate line.

The control signal includes a gate start pulse remaining at a high state during three periods of the modified data enable signal; first to third output enable signals remaining at a high state during three periods of the modified data enable signal while remaining at a low state during three periods of the modified data enable signal; and a gate shift clock remaining at a high state during one period of the modified data enable signal while remaining at a low state during one period of the modified data enable signal.

The second output enable signal rises at a time delayed by two periods of the modified data enable signal from a rising time of the first output enable signal, and the third output enable signal rises at a time delayed by two periods of the modified data enable signal from a rising time of the second output enable signal.

It is to be understood that both the foregoing general description and the following detailed description are exemplary and explanatory and are intended to provide further explanation of the invention as claimed

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to exemplary embodiments of the present invention, examples of which are illustrated in the accompanying drawings.

Figure 2:
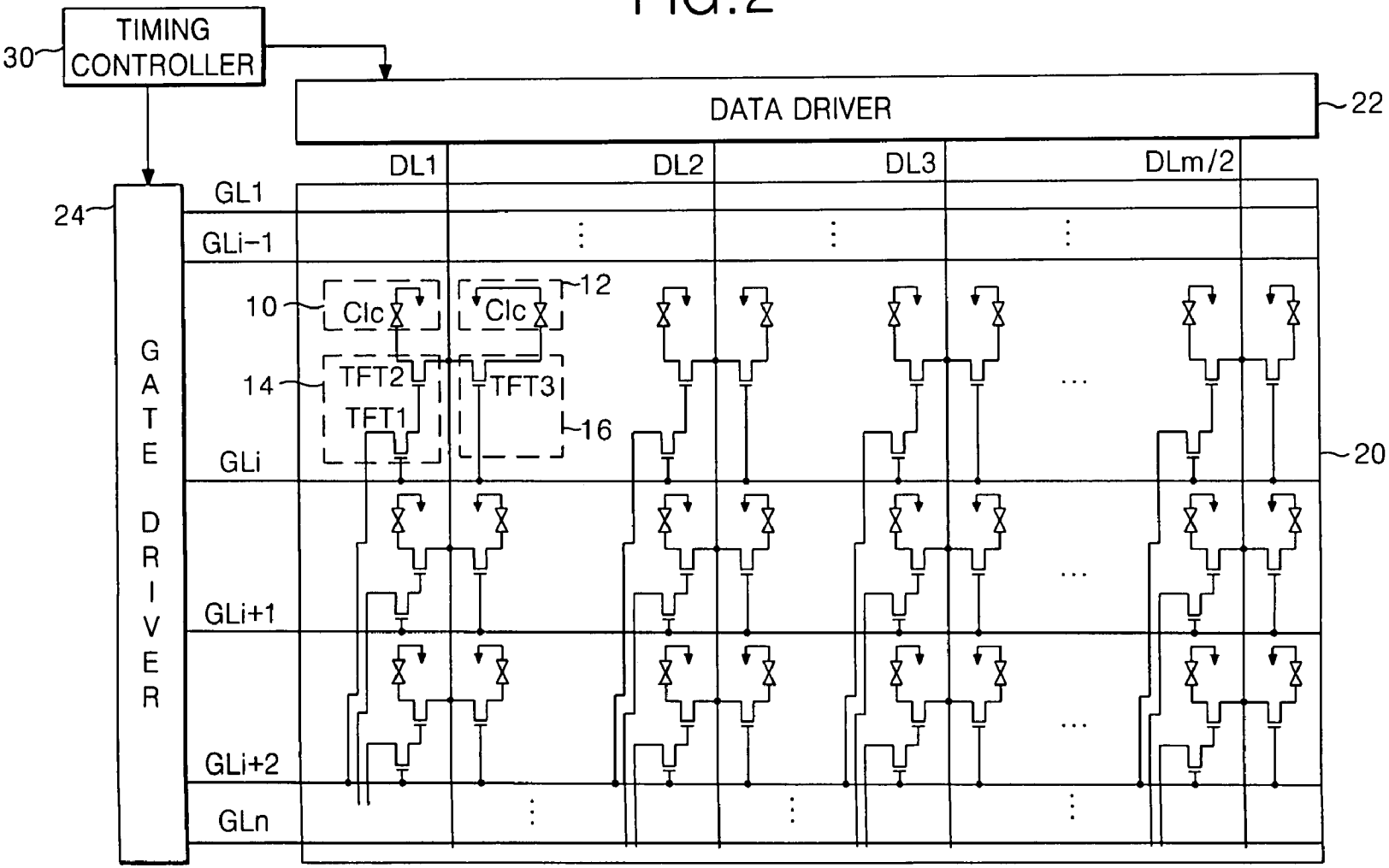
FIG. 2 is a block circuit diagram illustrating a configuration of a liquid crystal display according to an embodiment of the present invention.

FIG. 2 is a schematic diagram illustrating a liquid crystal display (LCD) according to an exemplary embodiment of the present invention.

Referring to FIG. 2, the LCD includes a liquid crystal display panel 20, a data driver 22 for driving data lines DL1 to DLm/2 of the liquid crystal display panel 20, a gate driver 24 for driving gate lines GL1 to GLn of the liquid crystal display panel 20, and a timing controller 30 for controlling the data driver 22 and the gate driver 24.

The liquid crystal display panel 20 has first and second liquid crystal cells 10 and 12 provided at crossings of the gate lines GL1 to GLn and the data lines DL1 to DLm/2, a first switching part 14 provided at each first liquid crystal cell 10 to drive the first liquid crystal cell 10, and a second switching part 16 provided at each second liquid crystal cell 12 to drive the second liquid crystal cell 12. The first and second liquid crystal cells 10 and 12 may be equivalently expressed as a liquid crystal capacitor Clc because they have a common electrode opposite a pixel electrode with liquid crystal therebetween. The pixel electrode is connected to each of the first and second switching parts 14 and 16. Herein, each of the first and second liquid crystal cells includes a storage capacitor (not shown) connected to a pre-stage gate line in order to maintain a data voltage charged in the liquid crystal capacitor Clc until the next data voltage is charged therein.

Figure 1:
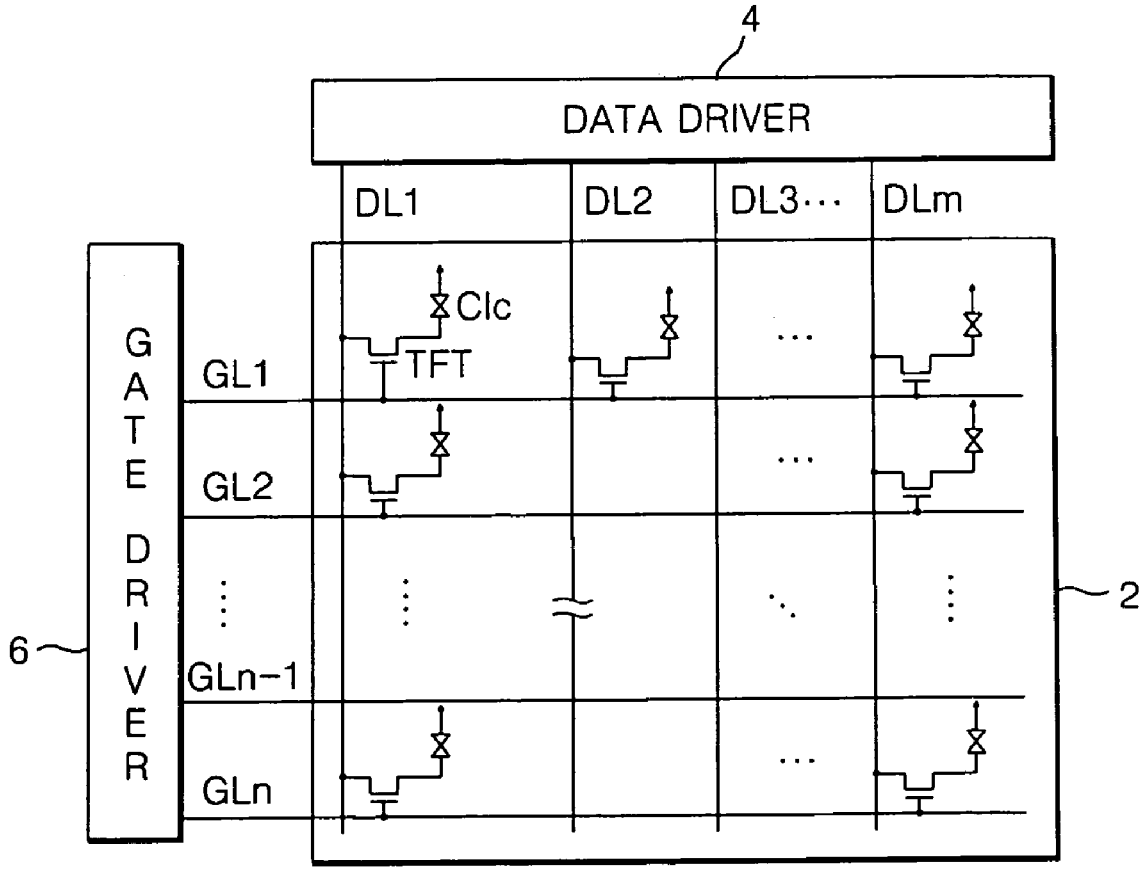
FIG. 1 RELATED ART
FIG. 1 is a block circuit diagram illustrating a configuration of a conventional liquid crystal display.

The first liquid crystal cell 10 and the first switching part 14 are provided at the left side of the data line DL, that is, at odd-numbered vertical lines. The second liquid crystal cell 12 and the second switching part 16 are provided at the right side of the data line DL, that is, at even-numbered vertical lines. In other words, the first and second liquid crystal cells 10 and 12 are provided at the left and right sides with a single of data line DL therebetween. In this case, the first and second liquid crystal cells 10 and 12 receive video signals from the data lines DL positioned adjacently to each other. Accordingly, the LCD according to this particular embodiment of the present invention allows the number of data lines DL to be reduced to half of that in the related art LCD shown in FIG. 1.

Figure 4:
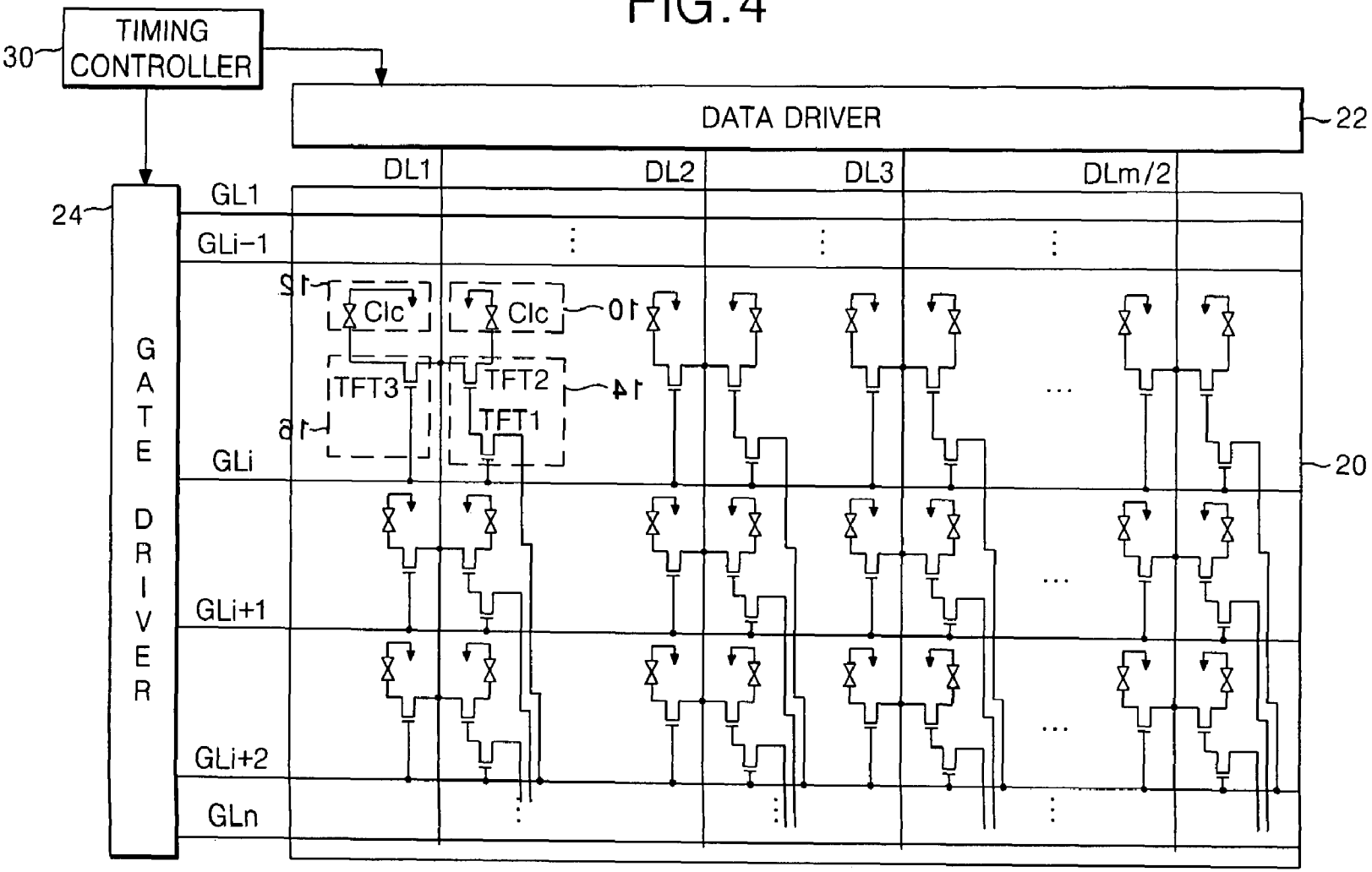
FIG. 4 is a block circuit diagram illustrating a configuration of a liquid crystal display according to another embodiment of the present invention.

In an alternative exemplary embodiment, illustrated in FIG. 4, a position of the first and second liquid crystal cells 10 and 12 may be different. In other words, the first liquid crystal cell 10 and the first switching part 14 may be provided at the right side of the data line DL while the second liquid crystal cell 12 and the second switching part 16 may be provided at the left side of the data line. In other words, the first liquid crystal cell 10 and the first switching part 14 may be provided at the even-numbered vertical lines while the second liquid crystal cell 12 and the second switching part 16 may be provided at the odd-numbered vertical lines.

The first switching part 14 for driving the first liquid crystal cell 10 positioned at the ith horizontal line (wherein i is an integer) includes first and second thin film transistors TFT1 and TFT2. The gate terminal of the first thin film transistor TFT1 is connected to the ith gate line GLi while the source terminal thereof is connected to (i+2)th gate line GLi+2. The gate terminal of the second thin film transistor TFT2 is connected to the drain terminal of the first thin film transistor TFT1 while the source terminal thereof is connected to the adjacent data line DL. Further, the drain terminal of the second thin film transistor TFT2 is connected to the first liquid crystal cell 10. When a driving signal is applied to the ith gate line GLi and the (i+2)th gate line GLi+2, the first switching part 14 applies a video signal to the first liquid crystal cell 10.

The second switching part 16 for driving the second liquid crystal cell 12 positioned at the ith horizontal line includes a third thin film transistor TFT3. The gate terminal of the third thin film transistor TFT3 is connected to the ith gate line GLi while the source terminal thereof is connected to the adjacent data line DL. Further, the drain terminal of the third thin film transistor TFT3 is connected to the second liquid crystal cell 12. When a driving signal is applied to the ith gate line GLi, the second switching part 16 applies a video signal to the second liquid crystal cell 12.

The data driver 22 converts data red (R), green (G), and blue (B) data signals from the timing controller 30 into analog video signals in order to apply them to the data lines DL1 to DLm/2. In this case, the LCD according to the embodiment of the present invention allows the number of data lines DL1 to DLm/2 to be reduced to half the number required in the related art LCD illustrated in FIG. 1, so that the number of data driving IC's included in the data driver 22 is also reduced by half.

Figure 3:
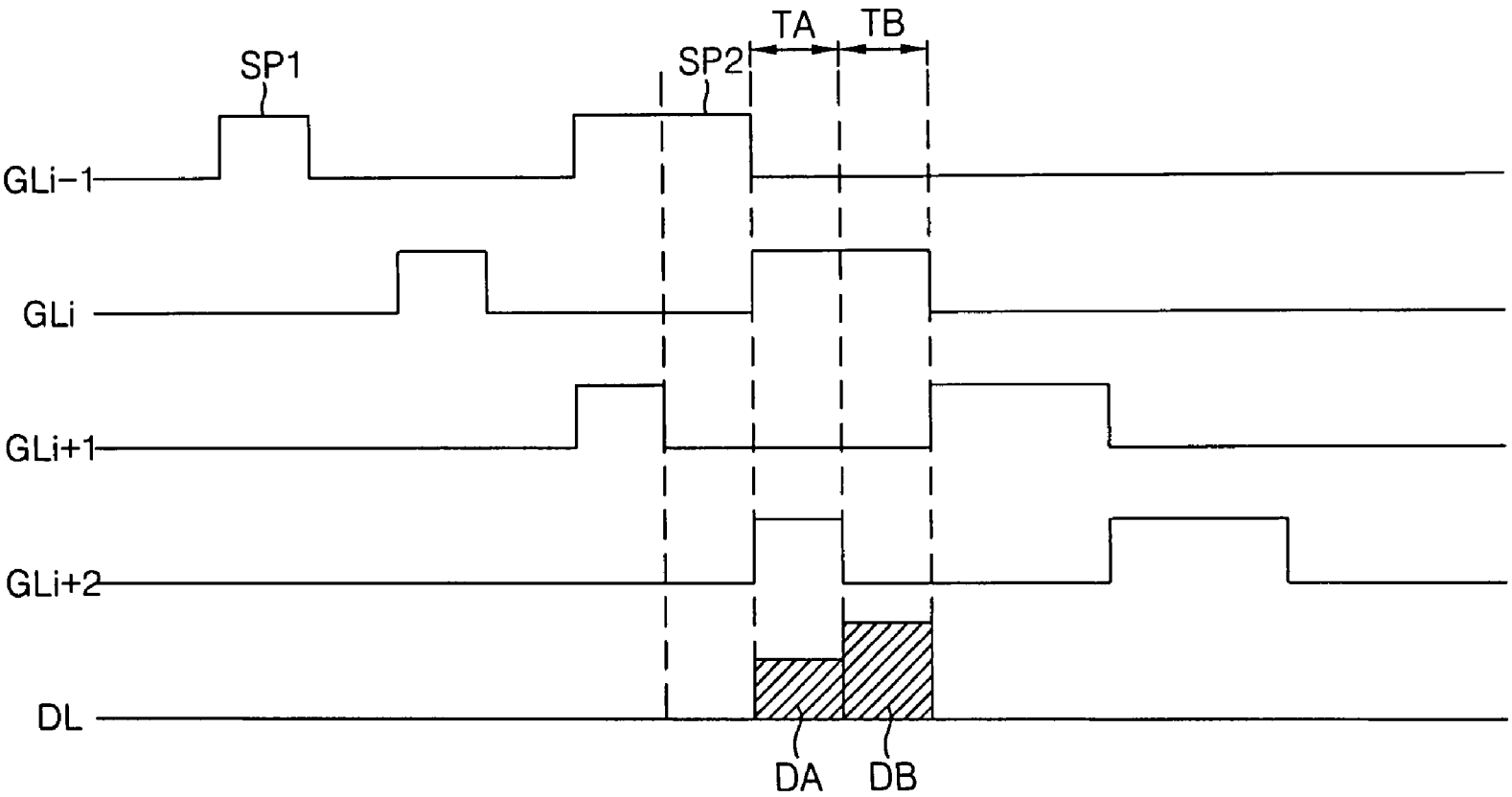
FIG. 3 is a waveform diagram of gate signals applied to the gate lines by the gate driver shown in FIG. 2.

The gate driver 24 sequentially applies first and second gate signals SP1 and SP2 to each gate line GL1 to GLn, as illustrated in FIG. 3, in response to a control signal from the timing controller 30. Herein, the second gate signal SP2 is set to have a larger width (longer duration) than the first gate signal SP1.

Meanwhile, the gate driver 24 applies the first and second gate signals SP1 and SP2 such that the second gate signal SP2 applied to the ith gate line GLi overlaps with the first gate signal SP1 applied to the (i+2)th gate line GLi+2 during a first period TA. Because a width of the second gate signal SP2 is larger than that of the first gate signal SP1, the second gate signal SP2 does not overlap with the first gate signal SP1 in a second period TB following the first period TA.

In other words, the second gate signal SP2 applied to the ith gate line GLi and the first gate signal SP1 applied to the (i+2)th gate line GLi+2 are applied simultaneously. Thus, during the first period TA, the second gate signal SP2 applied to the ith gate line GLi overlaps with the first gate signal SP1 applied to the (i+2)th gate line GLi+2. Thereafter, during the second period TB following the first period TA, the second gate signal SP2 is applied only to the ith gate line GLi.

A procedure in which video signals are applied to the liquid crystal cells 10 and 12 positioned at the ith horizontal line will be described below.

During the first period TA, the second gate signal SP2 is applied to the ith gate line GLi and, at the same time, the first gate signal SP1 is applied to the (i+2)th gate line GLi+2. The first gate signal SP1 applied to the (i+2)th gate line GLi+2 is applied to the source terminal of the first thin film transistor TFT1. Since the second gate signal SP2 applied to the ith gate signal GLi turns on the first thin film transistor TFT1, the first gate signal SP1 applied to the source terminal of the first thin film transistor TFT1 is applied to the gate terminal of the second thin film transistor TFT2 to thereby turn on the second thin film transistor TFT2. As the second thin film transistor TFT2 is turned on, a first video signal DA applied to the data line DL is applied to the first liquid crystal cell 10 via the second thin film transistor TFT2.

Subsequently, in the second period TB when the second gate signal SP2 is applied only to the ith gate line GLi, the third thin film transistor TFT3 is turned on. As the third thin film transistor TFT3 is turned on, a second video signal DB applied to the data line DL is applied to the second liquid crystal cell 12 via the third thin film transistor TFT3.

Since the second liquid crystal cell 12 is substantially supplied with the second gate signal SP2 in the first period TA, it charges the first video signal DA during the first period TA. However, the second video signal DB is supplied during the second period TB following the first period TA, so that a desired video signal DB can be charged in the second liquid crystal cell 12.

Figure 5:
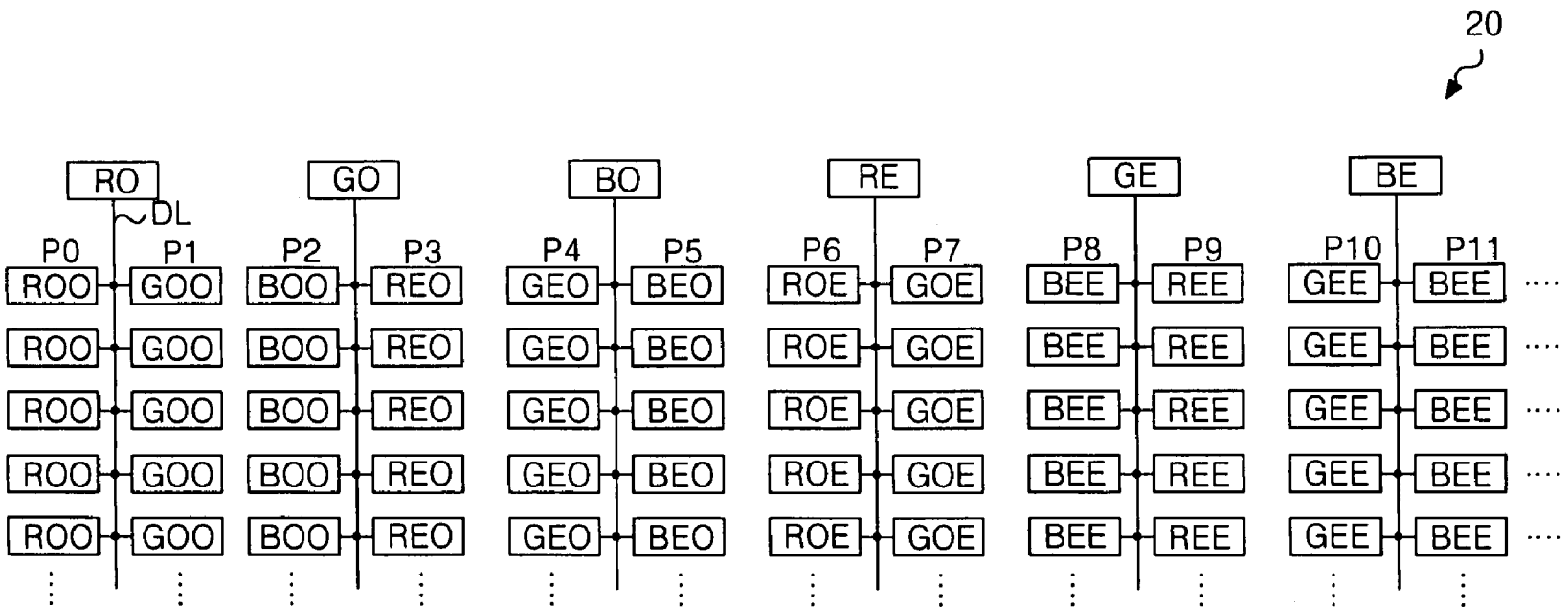
FIG. 5 is a view illustrating an operating procedure of the timing controller illustrated in FIG. 2, in which the data lines and the liquid crystal cells are separated.

The timing controller 30 controls the data driver 22 to continuously apply two data to each data line DL during one horizontal period. Further, the timing controller 30 controls the gate driver 24 such that the first and second gate signals SP1 and SP2 can be applied to the gate line GL. The liquid crystal display panel 20 is divided as illustrated in FIG. 5 for the purpose of explaining an operating procedure of the timing controller 30.

Figure 9A:
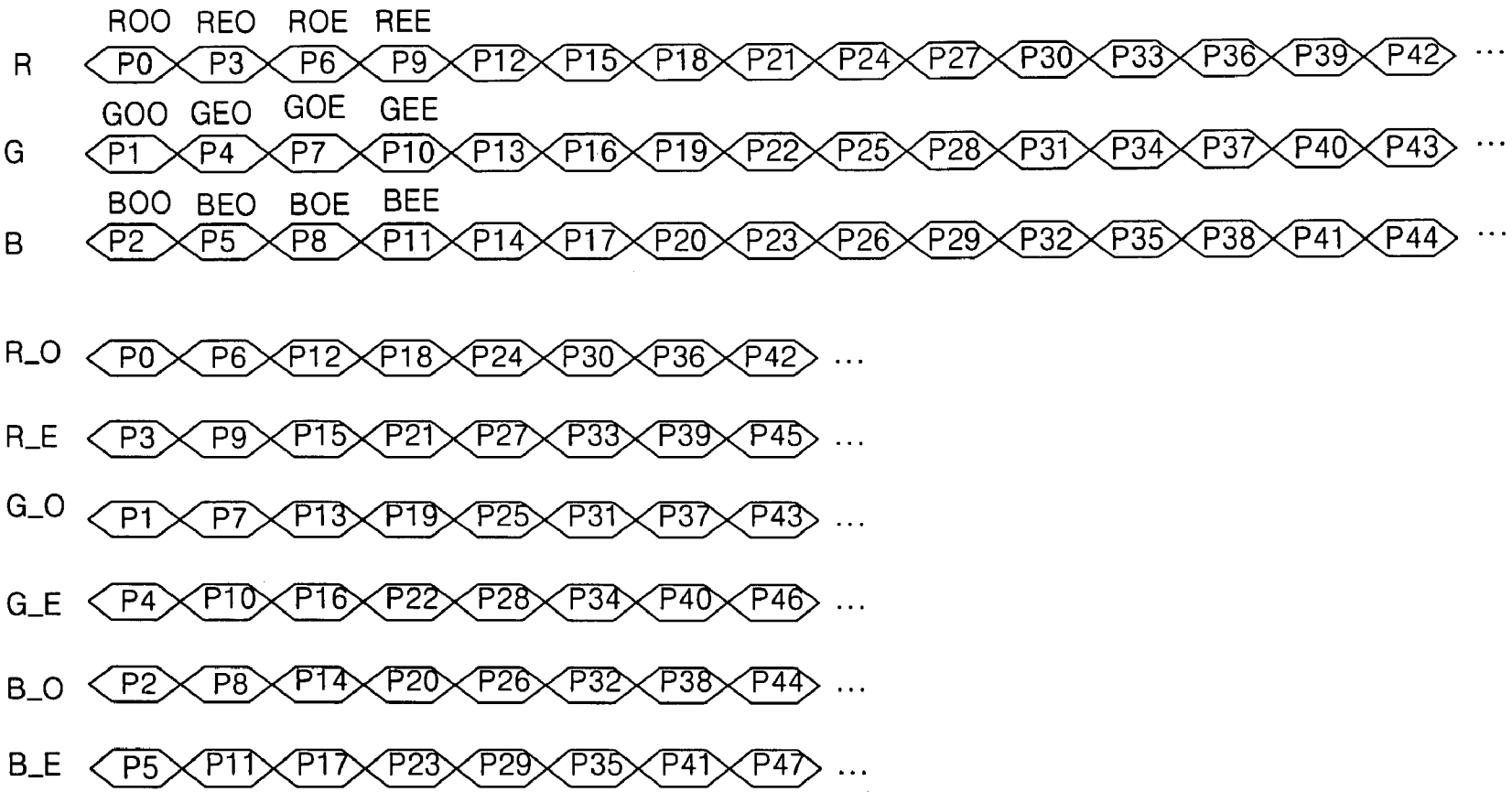
FIG. 9A and FIG. 9B illustrate an operation procedure of the timing controller shown in FIG. 6.

The data lines DL are divided into odd-numbered lines Ro, Go and Bo and even-numbered lines Re, Ge and Be. Further, the liquid crystal cells (i.e., sub-pixels) are divided into Roo, Goo, Boo, Reo, Geo, Beo, Roe, Boe, Ree, Gee and Bee, . . . as illustrated in FIG. 5 and FIG. 9A. Herein, 'Roo' means a red sub-pixel connected to the odd-numbered line and supplied with the odd-numbered data. 'Reo' means a red sub-pixel connected to the odd-numbered line and supplied with the even-numbered data. 'Ree' means a red sub-pixel connected to the even-numbered line and supplied with the even-numbered data. Furthermore, P0, P1, P2, . . . illustrated in FIG. 5 and FIG. 9A represent data applied to each sub-pixel.

Figure 6:
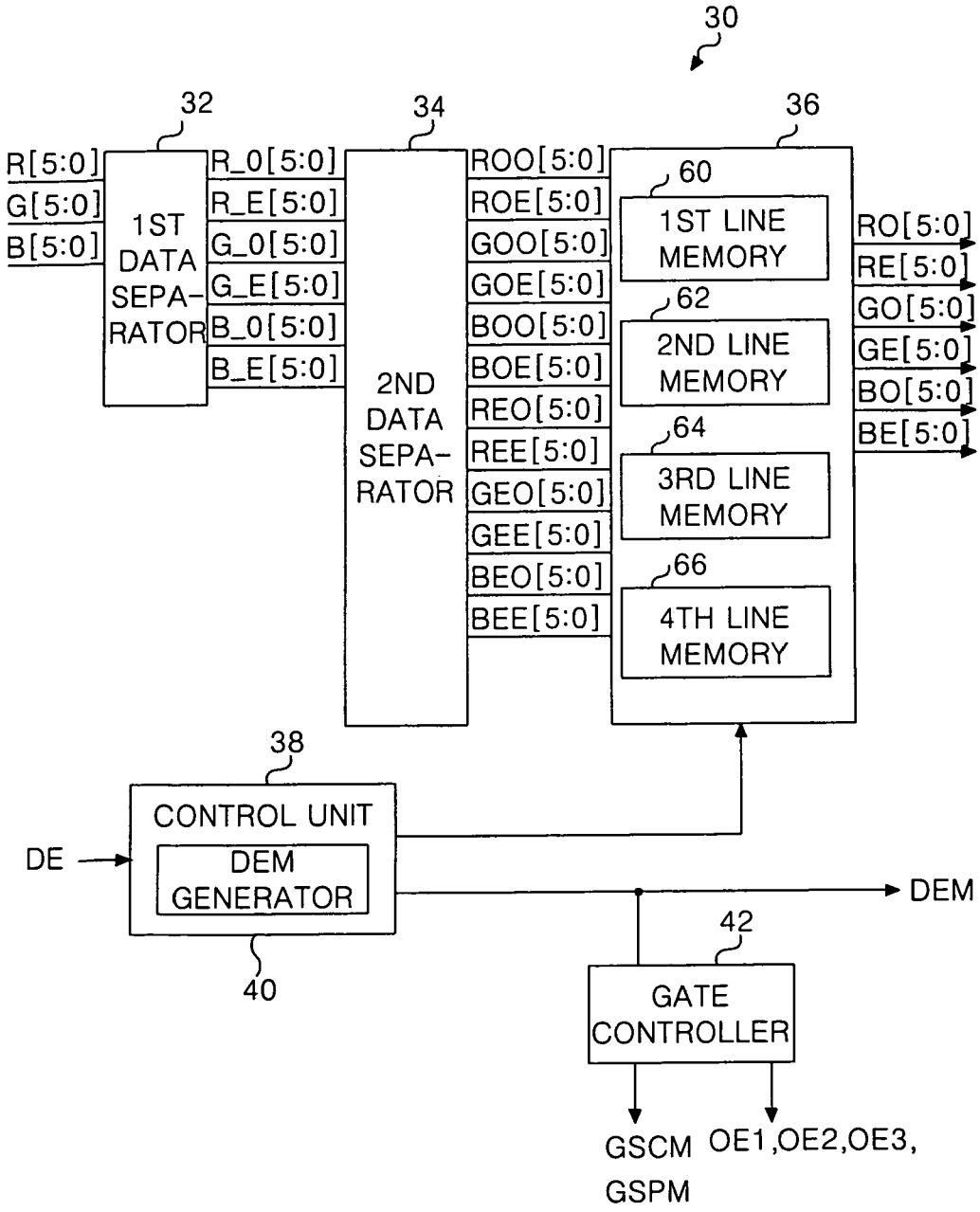
FIG. 6 is a block diagram of the timing controller illustrated in FIG. 2.

FIG. 6 illustrates the timing controller 30 according to an embodiment of the present invention.

Referring to FIG. 6, the timing controller 30 includes a first data separator 32 that separates data supplied from outside into odd data and even data, a second data separator 34 for again separating the data separated by the first data separator 32 into odd data and even data, a data storage unit 36 for storing data separated by the second data separator 34, a control unit 38 for controlling the data storage unit 36, and a gate controller 42 for controlling the gate driver 24.

Figure 7:
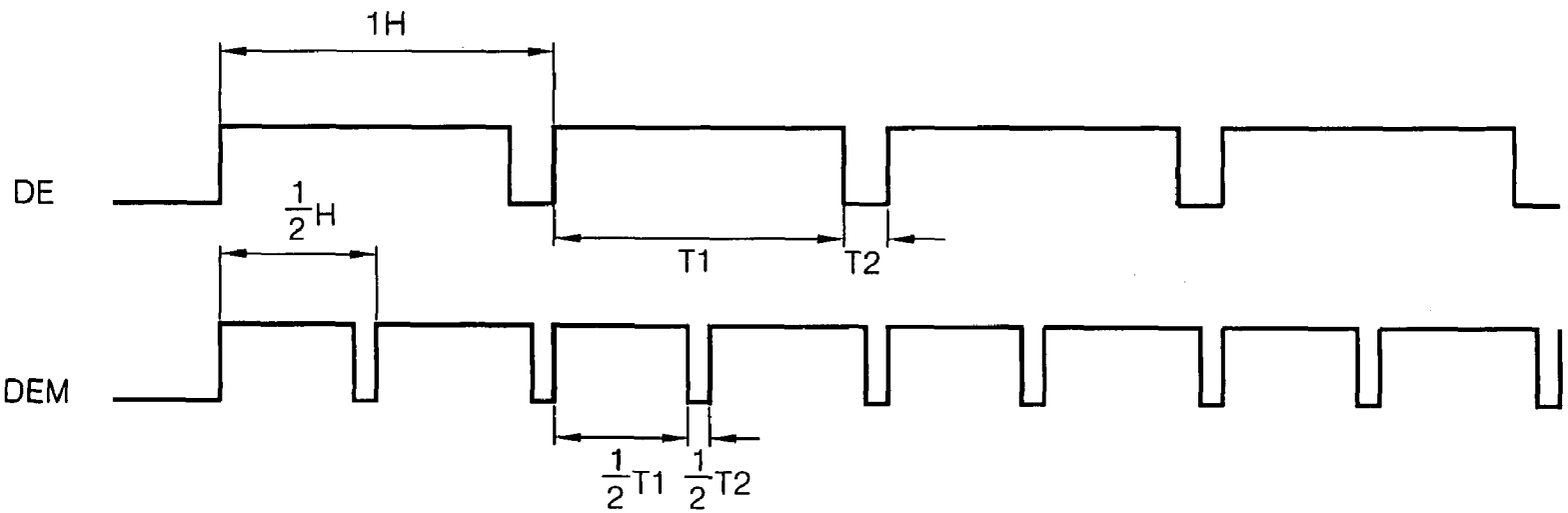
FIG. 7 is a waveform diagram representing an operation procedure of the DEM generator illustrated in FIG. 6.

The control unit 38 makes a two-frequency-division of a data enable signal DE from the exterior thereof to generate a modified data enable signal DEM as illustrated in FIG. 7. In other words, the control unit 38 makes a two-frequency-division of a data enable signal DE such that two data can be continuously applied to each data line DL during one horizontal period, thereby generating a modified data enable signal DEM. To achieve this, the control unit 38 includes a data enable modulation (DEM) generator 40. The DEM generator 40 is configured by a two-frequency-dividing circuit to generate the modified enable signal DEM using the data enable signal DE. Alternatively, the DEM generator 40 may be configured by a variety circuits.

Figure 8:
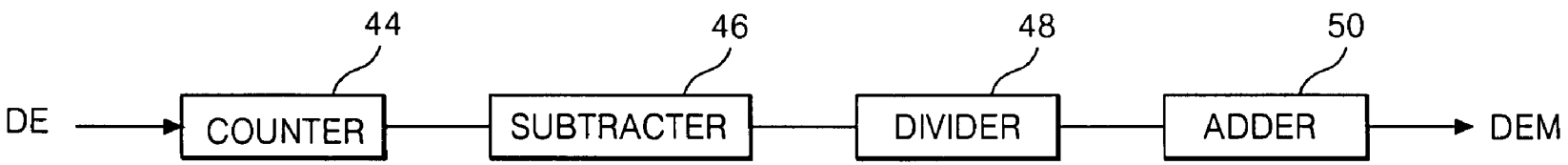
FIG. 8 is a detailed block diagram of the DEM generator illustrated in FIG. 6.

For instance, the DEM generator 40 may include a counter 44, a subtracter 46, a divider 48 and an adder 50, as illustrated in FIG. 8. The counter 44 counts one period (i.e., T1+T2) of the data enable signal DE from the exterior thereof, and applies the counted time to the subtracter 46. The subtracter 46 subtracts a low interval T2 of the data enable signal DE from the counted time applied from the counter 44 to calculate a high interval T1 of the data enable signal DE. The low interval T2 of the data enable signal DE is stored in the subtracter 46 in advance.

The divider 48 divides the high interval T2 from the subtracter 46 by two to thereby obtain a time T1/2. The adder 50 adds a T2/2 value obtained by dividing the low interval T2 of the data enable signal DE by two to the time T1/2 from the divider 48, thereby generating a modified data enable signal DEM as shown in FIG. 7. The T2/2 value obtained by dividing the low interval T2 of the data enable signal DE by two is stored in the adder 50 in advance.

As illustrated in FIG. 9A, the first data separator 32 receives red(R) data, green(G) data and blue(B) data from an external source. Each of the R, G and B data are applied to the first data separator 32 for each of the desired bits (for example, for each of 6 bits). The first data separator 32 having received the R, G and B data from the exterior divides each data into odd data and even data.

More specifically, the first data separator 32 divides the red(R) data into odd red data R_O and even red data R_E. Further, the first data separator 32 divides the green(G) data inputted from the exterior thereof into odd green data G_O and even green data G_E. Furthermore, the first data separator 32 divides the blue(B) data inputted from the exterior thereof into odd blue data B_O and even blue data B_E. The odd data R_O, G_O and B_O and the even data R_E, G_E and B_E separated by the first data separator 32 are applied to the second data separator 34. Herein, if the data divided into the odd data R_O, G_O and B_O and the even data R_E, G_E and B_E are applied to the second data separator 34, then the frequency is lowered to thereby reduce electromagnetic interference (EMI).

Figure 9B:
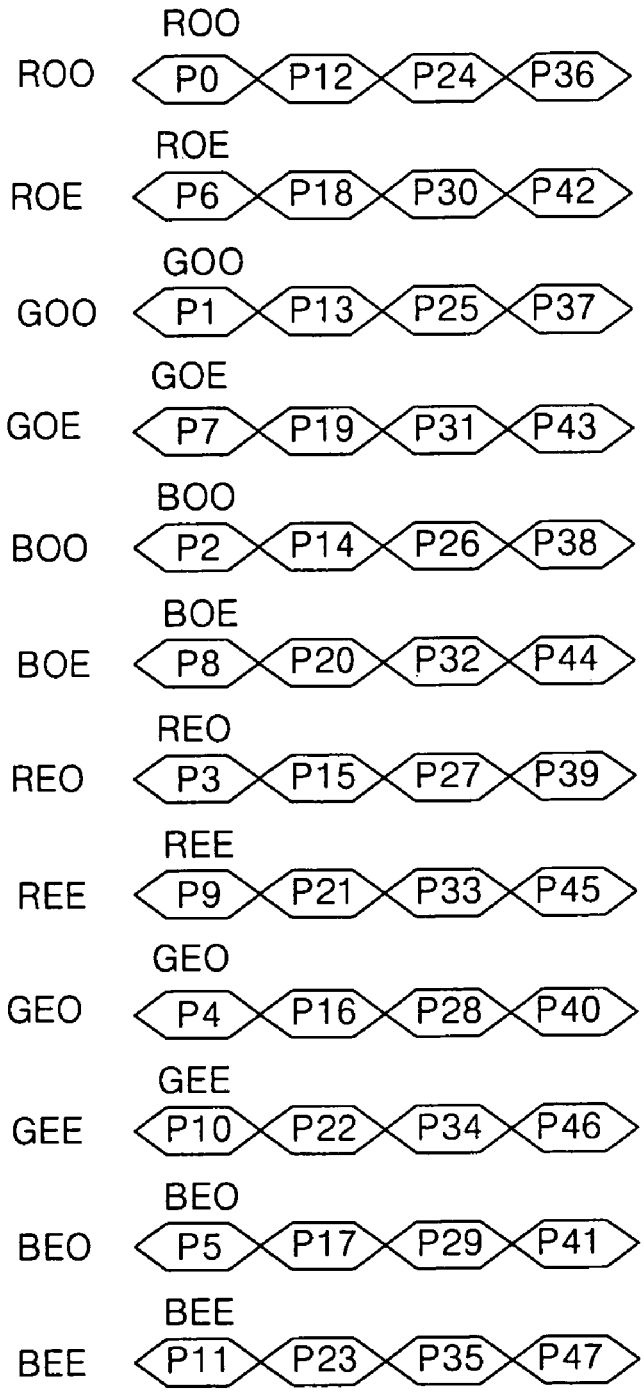

As illustrated in FIG. 9B, the second data separator 34 again divides the odd data R_O, G_O and B_O and the even data R_E, G_E and B_E inputted thereto into odd and even data. In other words, the second data separator 34 divides the odd red data R_O inputted thereto into the odd red data(odd) ROO and the odd red data(even) ROE. Further, the second data separator 34 divides the even red data R_E inputted thereto into the even red data(odd) REO and the even red data(even) REE.

Likewise, the second data separator 34 generates the odd green data(odd) GOO and the odd green data(even) GOE using the odd green data G_O while generating the even green data(odd) GEO and the even green data(even) GEE using the even green data G_E. Further, the second data separator 34 generator the odd blue data(odd) BOO and the odd blue data(even) BOE using the odd blue data B_O while generating the even blue data(odd) BEO and the even blue data(even) BEE using the even blue data B_E.

The data ROO, ROE, GOO, GOE, BOO, BOE, REO, REE, GEO, GEE, BEO and BEE separated by the second data separator 34 are applied to the data storage unit 36. Herein, the data ROO, ROE, GOO, GOE, BOO, BOE, REO, REE, GEO, GEE, BEO and BEE are applied to the data storage unit 36 in a divided state, so that a frequency is lowered to thereby reduce EMI.

The data storage unit 36, under control of the control unit 38, stores the data ROO, ROE, GOO, GOE, BOO, BOE, REO, REE, GEO, GEE, BEO and BEE applied thereto and applies the stored data ROO, ROE, GOO, GOE, BOO, BOE, REO, REE, GEO, GEE, BEO and BEE to the data driver 22.

Figure 10:
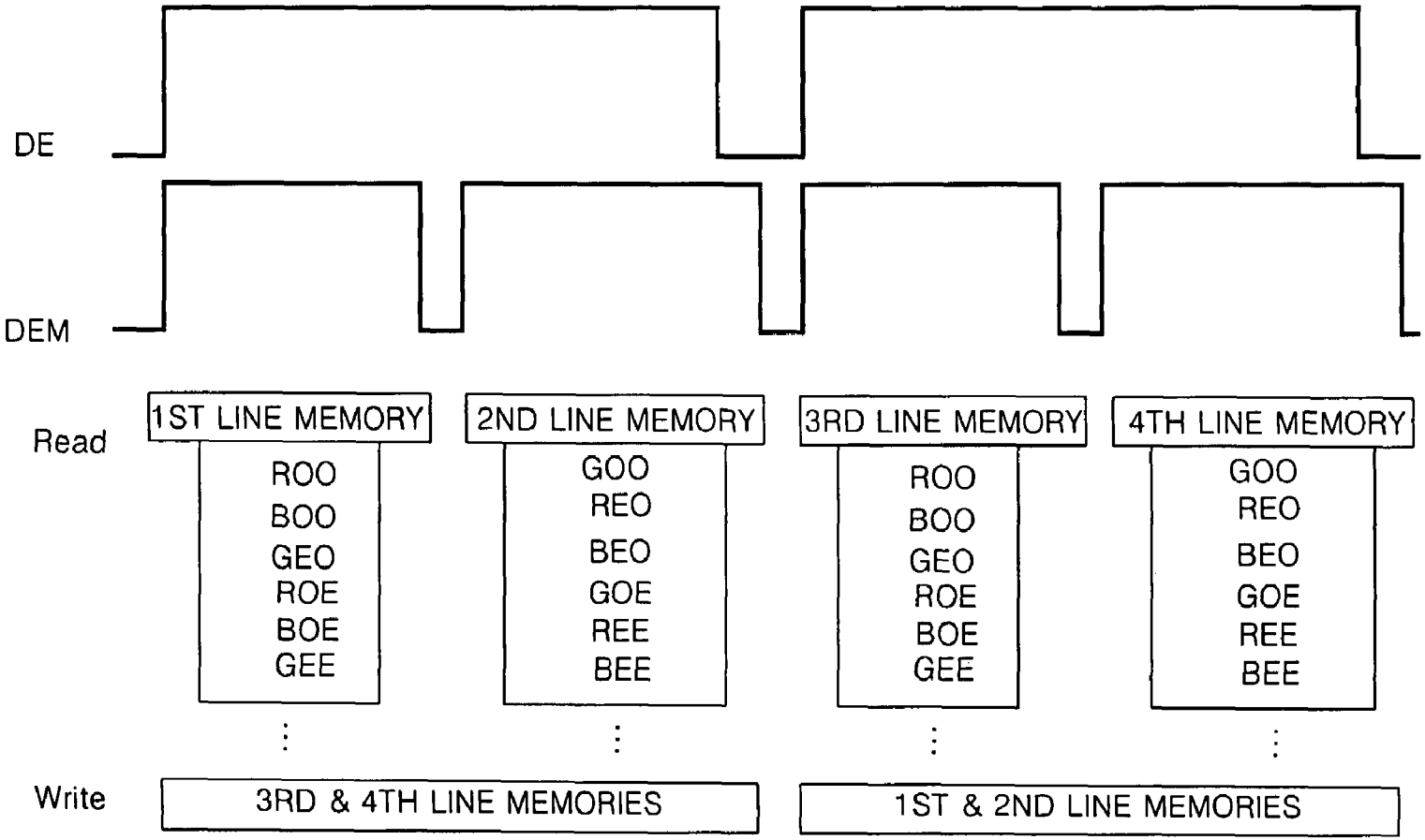
FIG. 10 depicts a procedure in which a data is stored in and outputted to the timing controller illustrated in FIG. 6.

This will be described in detail with reference to FIG. 10 below.

First, the data storage unit 36 stores the data ROO, ROE, BOO, BOE, GEO and GEE including even-numbered sub-pixel data P0, P2, P4 and P6, of the data ROO, ROE, GOO, GOE, BOO, BOE, REO, REE, GEO, GEE, BEO and BEE applied thereto into a first line memory 60 while storing the remaining data GOO, GOE, REO, REE, BEO and BEE into a second line memory 62. The first line memory 60 stores the even-numbered pixel data P0, P2, P4, P6, . . . , whereas the second line memory 62 stores the odd-numbered pixel data P1, P3, P5, P7, . . . .

Thereafter, the data storage unit 36 applies data stored in the first line memory 60 to the data driver 22 in the ith period (wherein i is an integer) of the modified data enable signal DEM while applying data stored in the second line memory 62 to the data driver 22 in the (i+1)th period thereof. In this case, the data driver 22 is synchronized with the modified data enable signal DEM, thereby applying the data supplied from the first line memory 60 to the data lines DL during an ½ horizontal period while applying the data supplied from the second line memory 62 to the data lines DL during the remaining ½ horizontal period. In other words, in the present exemplary embodiment, the odd-numbered pixel data and the even-numbered pixel data are divisionally applied to the data driver 22, to continuously apply two data signals to each data line DL during one horizontal period. Alternatively, the data stored in the second line memory may be first applied to the data driver 22 in correspondence with a structure of the liquid crystal cell.

Meanwhile, during the ith period and the (i+1)th period of the modified data enable signal DEM, the data ROO, ROE, BOO, BOE, GEO and GEE including the even-numbered sub-pixel data P0, P2, P4 and P6 are stored in a third line memory 64 while the remaining data GOO, GOE, REO, REE, BEO and BEE are stored in a fourth line memory 66. Thereafter, the data stored in the third line memory 64 are applied to the data driver 22 in the (i+2)th period of the modified data enable signal DEM while the data stored in the fourth line memory 66 are applied to the data driver 22 in the (i+3)th period thereof. Further, during the (i+2)th period and the (i+3)th period of the modified data enable signal DEM, the data are stored in the first and second line memories 60 and 62. In other words, the data storage unit 36 stores data and applies the stored data to the data driver 22, thereby continuously supplying the data. Alternatively, the data stored in the fourth line memory may be firstly applied to the data driver 22 in correspondence with a structure of the liquid crystal cell.

In this case, the data driver 22 is synchronized with the modified data enable signal DEM, thereby applying the data supplied from the third line memory 64 to the data lines DL during an ½ horizontal period while applying the data supplied from the fourth line memory 66 to the data lines DL during the remaining ½ horizontal period. In other words, in the present embodiment, the odd-numbered pixel data and the even-numbered pixel data are divisionally applied to the data driver 22, thereby continuously applying two data signals to each data line DL during one horizontal period.

Figure 11:
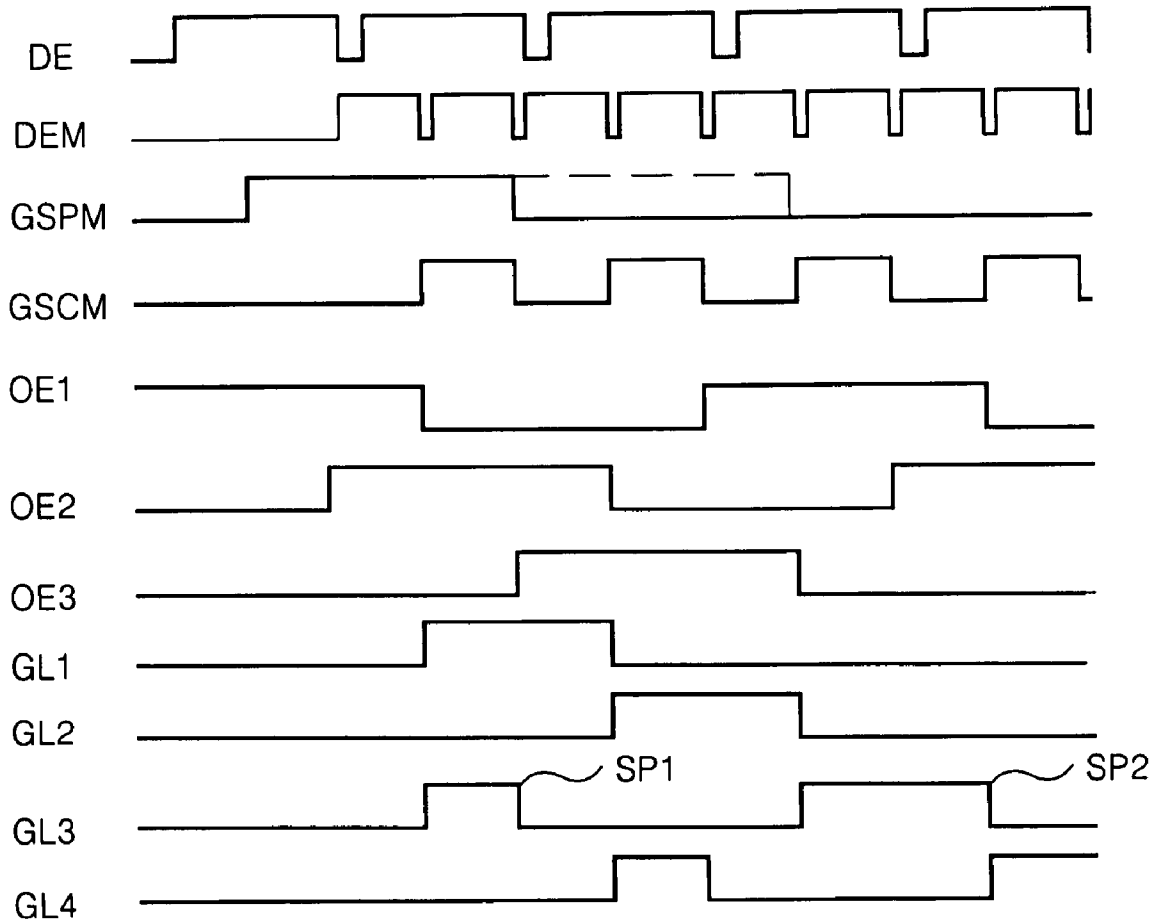
FIG. 11 is a waveform diagram illustrating an operation procedure of the gate controller illustrated in FIG. 6.

The gate controller 42 generates gate signals applied to the gate driver 24 under control of the control unit 38. With reference to FIG. 11, the gate controller 42 a gate start pulse GSPM, output enable signals OE1, OE2 and OE3 and a gate shift clock GSCM using the modified data enable signal DEM to apply them to the gate driver 24.

The gate start pulse GSPM remains at a high state during three periods of the modified data enable signal DEM. The gate driver 24 supplied with the gate start pulse GSPM sequentially shifts the gate start pulse GSPM to generate a gate signal. The dotted line in FIG. 11 represents a time interval at which the gate start pulse GSPM has been shifted by one period.

The first to third output enable signals OE1 to OE3 have a period corresponding to 6 periods of the modified data enable signal DEM. Herein, the first to third output enable signals OE1 to OE3 remain at a high state during three periods of the modified data enable signal DEM while remaining at a low state during the remaining three periods thereof. Meanwhile, the second output enable signal OE2 is raised at a time delayed by two periods of the modified data enable signal DEM from a rising time of the first output enable signal OE1. The third output enable signal OE3 is raised at a time delayed by two periods of the modified data enable signal DEM from a rising time of the second output enable signal OE2.

The first to third output enable signals OE1 to OE3 control an output of the gate driver 24. More specifically, when the first output enable signal OE1 has a high state, a low signal VGL is applied to the jth gate line GLj (wherein j is an integer of 1, 4, 7, 10, . . .). Further, when the second output enable signal OE2 has a high state, a low signal VGL is applied to the (j+1)th gate line GLj+1. Furthermore, when the third output enable signal OE3 has a high state, a low signal VGL is applied to the (j+2)th gate line GLj+2.

The gate shift clock GSCM has a period corresponding to two periods of the modified data enable signal DEM. Herein, the gate shift clock GSCM remains at a high state during one period of the modified data enable signal DEM while remaining at a low state during the remaining one period thereof. The gate driver 24 supplied with the gate shift clock GSCM is synchronized with a rising edge of the gate shift clock GSCM to generate the first and second gate signals SP1 and SP2.

More specifically, firstly, the gate start pulse GSPM remains at a high state at the first rising time of the gate shift clock GSCM. Herein, since the first and third output enable signals OE1 and OE3 remain at a low state, a gate signal is applied to the first and third gate lines GL1 and GL3. Thereafter, the gate signal SP1 applied to the third gate line GL3 is converted into a low state at a high-state time of the third output enable signal OE3. On the other hand, the gate signal SP2 applied to the first gate line GL1 is converted into a low state at the second rising time of the gate shift clock GSCM.

The gate shift pulse, as indicated by the dotted line, shifted at the second rising time of the gate shift clock GSCM remains at a high state. Herein, since the first and second output enable signals OE1 and OE2 remain at a high state, a gate signal is applied to the second and fourth gate lines GL2 and GL4. Thereafter, the gate signal SP1 applied to the fourth gate line GL4 is converted into a low state at a high-state time of the first output enable signal OE1. On the other hand, the gate signal SP2 applied to the second gate line GL2 is converted into a low state at the third rising time of the gate shift clock GSCM. The present embodiment applies the first and second gate signals SP1 and SP2 to the gate line GL while repeating the above-mentioned procedure.

As described above, according to the present invention, a single data line drives first and second liquid crystal cells positioned adjacently to each other at the left and right sides thereof, so that the number of data lines can be reduced by half. Furthermore, the timing controller divides pixel data into odd pixel data and even pixel data to apply them to the data driver, and makes a two-frequency-division of the data enable signal to apply them to the data driver, so that two data can be continuously applied to each data line during one horizontal period. Moreover, gate control signals are generated with the aid of the two-frequency-divided data enable signal from the timing controller, so that the first and second gate signals can be stably applied to each gate line.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving apparatus for a liquid crystal display including a plurality of data lines with sub-pixels arranged at the left and right sides of the data lines connected to each data line, the apparatus comprising:

a liquid crystal display panel having a first and a second liquid crystal cells provided at crossings of a plurality of gate lines and a plurality of data lines, a first switching part driving the first liquid crystal cell, and a second switching part driving the second liquid crystal cell, wherein the first liquid crystal cell and the first switching part are provided at one side of the data lines, wherein the second liquid crystal cell and the second switching part are provided at another side of the data line;

a timing controller that receives red sub-pixel data, green sub-pixel data and blue sub-pixel data and then divides the received data into odd-numbered sub-pixel data and even-numbered sub-pixel data;

a data driver that receives the odd-numbered sub-pixel data and the even-numbered sub-pixel data from the timing controller during one horizontal period and then applies the received odd-numbered and even-numbered sub-pixel data to the data lines during the one horizontal period; and a gate driver sequentially applying a first and second gate signals to the gate lines so that the second gate signal applied to a ith (wherein i is an integer) gate line overlaps with a part of the first gate signal applied to a (i+2)th gate line, wherein the first switching part drives the first liquid crystal cell in response to the second gate signal applied to the ith gate line and the first gate signal applied to the (i+2)th gate line, wherein the second switching part drives the second liquid crystal cell in response to the the second gate signal applied to the ith gate line.

2. The driving apparatus according to claim 1, wherein the timing controller includes:

a first data separator that separates each of the red, green and blue sub-pixel data into odd-numbered data and even-numbered data to generate a first sub-pixel data;

a second data separator that separates the first sub-pixel data into odd-numbered sub-pixel data and even-numbered sub-pixel data to generate a second sub-pixel data;

data storage that stores the second sub-pixel data; and a controller that controls the data storage.

3. The driving apparatus according to claim 2, wherein the controller includes a modified data enable signal generator that makes a two-frequency-division of a data enable signal to generate a modified data enable signal.

4. The driving apparatus according to claim 3, wherein the modified data enable signal generator divides each of a high region and a low region of the data enable signal into two regions and makes a summation of the two-divided high region and the two-divided low region, thereby generating the modified data enable signal.

5. The driving apparatus according to claim 4, wherein the modified data enable signal generator includes:

a counter that counts one period of the data enable signal;

a subtracter that subtracts a low region of the data enable signal from the counted one-period time to calculate a high region of the data enable signal;

a divider that divides the high region of the data enable signal outputted from the subtracter by two; and an adder that adds the two-divided high region of the data enable signal outputted from the divider to the two-divided low region of the data enable signal stored therein to generate the modified data enable signal.

6. The driving apparatus according to claim 3, wherein the first data separator divides each of the red, green and blue sub-pixel data into odd-numbered sub-pixel data and even-numbered sub-pixel data to generate a first sub-pixel data including odd red sub-pixel data, even red sub-pixel data, odd green sub-pixel data, even green sub-pixel data, odd blue sub-pixel data and even blue sub-pixel data; and wherein the second data separator divides the odd red sub-pixel data, the even red sub-pixel data, the odd green sub-pixel data, the even green sub-pixel data, the odd blue sub-pixel data and the even blue sub-pixel data into odd-numbered sub-pixel data and even-numbered sub-pixel data to generate a second sub-pixel data including odd red sub-pixel data(odd), odd red sub-pixel data(even), even red sub-pixel data(odd), even red sub-pixel data(even), odd green sub-pixel data(odd), odd green sub-pixel data(even), even green sub-pixel data(odd), even green sub-pixel data (even), odd blue sub-pixel data(odd), odd blue sub-pixel data(even), even blue sub-pixel data(odd) and even blue sub-pixel data(even).

7. The driving apparatus according to claim 3, wherein the data storage includes at least two line memories that store the second sub-pixel data.

8. The driving apparatus according to claim 7, wherein the data storage includes four line memories that store the second sub-pixel data.

9. The driving apparatus according to claim 8, wherein the controller alternately stores the odd-numbered sub-pixel data of the second sub-pixel data into the first and third line memories, and alternately stores the even-numbered sub-pixel data of the second sub-pixel data into the second and fourth line memories.

10. The driving apparatus according to claim 9, wherein the data stored in the first line memory is applied to the data driver in the ith period (wherein i is an integer) of the modified data enable signal, and the data stored in the second line memory is applied to the data driver in the (i+1)th period of the modified data enable signal.

11. The driving apparatus according to claim 10, wherein, during the ith and (i+1)th periods, the odd-numbered sub-pixel data is stored in the third line memory and the even-numbered sub-pixel data is stored in the fourth line memory.

12. The driving apparatus according to claim 9, wherein the data stored in the third line memory is applied to the data driver in the ith period of the modified data enable signal, and the data stored in the fourth line memory is applied to the data driver in the (i+1)th period of the modified data enable signal.

13. The driving apparatus according to claim 12, wherein, during the ith and (i+1)th periods, the odd-numbered sub-pixel data is stored in the first line memory and the even-numbered sub-pixel data is stored in the second line memory.

14. The driving apparatus according to claim 3, wherein the timing controller includes a gate controller that applies first and second gate signals from a gate driver to gate lines and that controls the gate driver such that the second gate signal applied to the ith gate line (wherein i is an integer) can overlap with the first gate signal applied to (i+2)th gate line.

15. The driving apparatus according to claim 14, wherein the gate controller generates a gate start pulse remaining at a high state during three periods of the modified data enable signal;

first to third output enable signals remaining at a high state during three periods of the modified data enable signal while remaining at a low state during three periods of the modified data enable signal; and a gate shift clock remaining at a high state during one period of the modified data enable signal while remaining at a low state during one period of the modified data enable signal, thereby applying them to the gate driver.

16. The driving apparatus according to claim 15, wherein the second output enable signal rises at a time delayed by two periods of the modified data enable signal from a rising time of the first output enable signal, and the third output enable signal rises at a time delayed by two periods of the modified data enable signal from a rising time of the second output enable signal.

17. A method of driving a liquid crystal display including first and a second liquid crystal cells provided at crossings of a plurality of gate lines and a plurality of data lines, a first switching part driving the first liquid crystal cell, and a second switching part driving the second liquid crystal cell, the method comprising the steps of:

(A) making a two-frequency-division of a data enable signal supplied from the exterior thereof to generate a modified data enable signal;

(B) dividing received a sub-pixel data into odd-numbered sub-pixel data and even-numbered sub-pixel data;

(C) applying the odd-numbered sub-pixel data to the data lines during one period of the modified data enable signal;

(D) applying the even-numbered sub-pixel data to the data lines during one period of the modified data enable signal;

(E) sequentially applying a first and second gate signals to the gate lines so that the second gate signal applied to a ith (wherein i is an integer) gate line overlaps with a part of the first gate signal applied to a (i+2)th gate line;

(F) charging the odd-numbered sub-pixel data to the first liquid crystal cell in response to the second gate signal applied to the ith gate line and the first gate signal applied to the (i+2)th gate line using the first switching part; and (G) charging the even-numbered sub-pixel data to the second liquid crystal cell in response to the the second gate signal applied to the ith gate line using the second switching part.

18. The method according to claim 17, wherein the step (A) includes generating the modified data enable signal by making a summation of a two-divided high region and a two-divided low region of the data enable signal.

19. The method according to claim 17, wherein the step (B)includes dividing each of red, green and blue sub-pixel data into odd-numbered sub-pixel data and even-numbered sub-pixel data to generate a first sub-pixel data;

dividing the first sub-pixel data into odd-numbered sub-pixel data and even-numbered sub-pixel data to generate a second sub-pixel data; and extracting the odd-numbered sub-pixel data and the even-numbered sub-pixel data from the second sub-pixel data and storing them.

20. The method according to claim 17, further comprising:

(H) generating a gate start pulse remaining at a high state during three periods of the modified data enable signal, first to third output enable signals remaining at a high state during three periods of the modified data enable signal while remaining at a low state during three periods of the modified data enable signal, and a gate shift clock remaining at a high state during one period of the modified data enable signal while remaining at a low state during one period of the modified data enable signal.

21. The method according to claim 20, wherein the second output enable signal rises at a time delayed by two periods of the modified data enable signal from a rising time of the first output enable signal, and the third output enable signal rises at a time delayed by two periods of the modified data enable signal from a rising time of the second output enable signal.

* * * * *